US005899134A

United States Patent [19]

Klein et al.

[11] Patent Number: 5,899,134

[45] Date of Patent: May 4, 1999

[54] BRAIDED FABRIC AND METHOD OF FORMING

[75] Inventors: John T. Klein, Mobile; Roy M. Broughton, Jr.; David G. Beale, both of Auburn, all of Ala.

[73] Assignee: Auburn University, Auburn University, Ala.

[21] Appl. No.: 08/929,946

[22] Filed: Sep. 15, 1997

[51] Int. Cl.[6] ..... D04C 1/00

[52] U.S. Cl. ..... 87/9; 87/13

[58] Field of Search ..... 87/6, 8, 9, 13

[56] References Cited

U.S. PATENT DOCUMENTS

| | | | |
|---|---|---|---|
| 3,007,497 | 11/1961 | Shobert | 138/125 |
| 3,446,251 | 5/1969 | Dow | 139/383 |
| 4,741,087 | 5/1988 | Plummer, Jr. | 29/446 |
| 4,777,859 | 10/1988 | Plummer, Jr. | 87/7 |
| 5,197,370 | 3/1993 | Gladfelter | 87/7 |
| 5,619,903 | 4/1997 | Rogers et al. | 87/8 |
| 5,700,533 | 12/1997 | You | 87/8 |

FOREIGN PATENT DOCUMENTS

| | | | |
|---|---|---|---|
| 2622902 | 5/1989 | France | 87/6 |

*Primary Examiner*—William Stryjewski

*Attorney, Agent, or Firm*—Henry S. Jaudon; Cort Flint

[57] ABSTRACT

An axially stable tubular braided fabric comprising a longitudinal set of yarns extending longitudinally of the fabric, a first set of yarns arranged substantially along a first cylindrical plane and at an angle relative to the longitudinal yarns and a second set of yarns arranged substantially along a second cylindrical plane and transversely of the first set of yarns. The yarns of the longitudinal set are passed consecutively over one and under the other of the yarns of the first and second sets interlocking these yarns together in an axially stable position with the yarns of the first set predominating the outer surface and the yarns of the second set predominating the inner surface.

18 Claims, 4 Drawing Sheets

BRAIDED FABRIC AND METHOD OF FORMING

BACKGROUND OF THE INVENTION

This invention relates to the method of forming and a braided fabric having exceptional longitudinal stability. The fabric may be produced by hand, on a machine as described in co-pending patent application Ser. No. 09/008,455, filed Jan. 16, 1998, or by other known braiding machines.

Tubular braided fabrics are well known as braiding is one of the oldest forms of fabric making. Braided fabrics constructed for longitudinal stability are also well known. Known tubular braided structures which incorporate longitudinal yarns are shown in U.S. Pat. No. 3,007,497 to Shobert; No. 4,741,087 and No. 4,777,859 to Plummer; and No. 5,197,370 to Sladfelter. In each of these patents, the angularly and transversely disposed yarns are moved in an over and under relationship across the fabric. To arrange these yarns in this manner requires machinery capable of extensive manipulations. The process places portions of both yarns on each surface of the fabric which limits design capabilities and does not significantly improve stability.

Similar structures have been woven flat on triaxial looms. In U.S. Pat. No. 3,446,251 the yarns Y and Z are weft yarns which are moved in successive passes across and through warp yarns X in an over and under relationship for the construction of flat triaxial woven fabrics. This fabric is not formed of continuous yarns in a continuous motion along a longitudinal axis and is not formed as a tubular fabric.

It is an object of the instant invention to overcome these short comings of the prior art.

Another object of the invention is to form a braided structure bound together with only the longitudinal yarns.

Another object of the invention is to provide a tubular braided fabric with at least certain of its forming yarn groups restricted to a single fabric side.

It is another object of the invention to provide a braided fabric with selected longitudinal elongation.

It is another object of the invention to provide a braided fabric with exceptional longitudinal strength.

It is another object of the invention to provide a braided fabric having selectible crimp, which allows for the control of longitudinal elongation.

It is another object of the invention to provide a method of forming a fabric with the above qualities.

SUMMARY OF THE INVENTION

The above objectives are accomplished according to the present invention with an axially stable braided fabric comprising a set of continuous yarns extending longitudinally thereof, a first set of continuous yarns arranged substantially along a first plane circumferential position and disposed at an angle relative to the longitudinal yarns, and a second set of continuous yarns arranged substantially along a second plane circumferential position and disposed transversely of the first set of yarns.

The yarns of the longitudinal set of yarns pass between and substantially through the first and second planes and are arranged consecutively over one and under the other of the yarns of the first and second sets of yarns. The yarns of the longitudinal set of yarns in so doing interlock with the yarns of the first and second sets of yarns and form an integral and axially stable tubular braided fabric.

The yarns of the first and second sets and the longitudinal set may be of equal size or of different in sizes or the yarns of the first and second sets may be of equal size and the yarns of the longitudinal set may be of a second and different size. The longitudinal yarn size may be equal to, smaller or larger than the size of the first two sets.

The yarns of the fabric may be synthetic, natural or mixed. The material forming the yarns of the first, second, and longitudinal sets may be the same or may differ between sets as desired.

The yarns of the first set, the second set and the longitudinal set of yarns are normally disposed throughout the fabric in equal numbers per unit area of the fabric. It is possible for the number of yarns of one set to differ from the number of yarns of at least one of the other two sets.

The invention is also directed to the method of forming an axially stable braided tubular fabric including the steps:

of providing a first, second, and third set of yarns about a longitudinal axis;

of delivering the yarns of the first set of yarns along substantially a first concentric cylindrical plane circumferential position and in a first direction relative to a longitudinal axis;

of delivering yarns of the second set of yarns along substantially a second concentric cylindrical plane circumferential position and in a second direction relative to the longitudinal axis so that the second set of yarns are disposed transverse and inwardly of the first set of yarns; and of delivering the yarns of the third set of yarns along a third plane circumferential position along the longitudinal axis while passing these yarns successively over and under the yarns of the first and second sets of yarns;

of causing the yarns of the first set of yarns to move temporally from the first plane outwardly and over successive yarns of the third set of yarns; and of causing the yarns of the second set of yarns to move temporally from second plane inwardly and beneath successive of the yarns of the third set of yarns; whereby the yarns of the first, second, and third sets are interlaced to form a longitudinally stable tubular braided fabric.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 5 is a sectional top view of an alternative embodiment in which additional longitudinal yarns are laid in.

DESCRIPTION OF A PREFERRED EMBODIMENT

Figure 1:
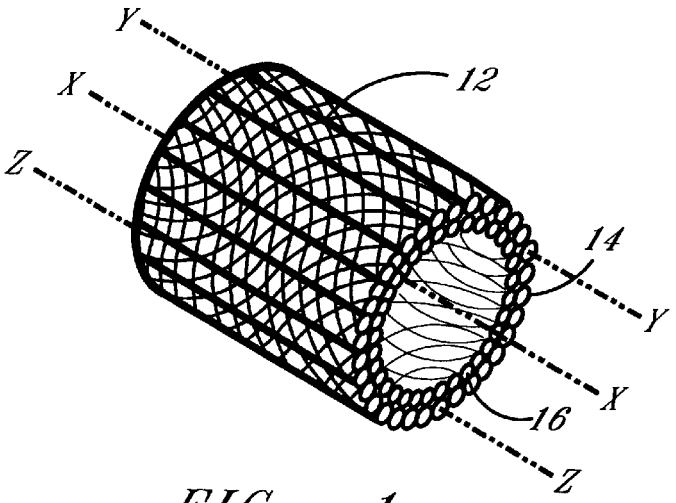
FIG. 1 is a sectional perspective view of the tubular braided fabric of the invention.

Referring now to the drawings, the invention will now be described in more detail.

FIG. 1 is a perspective view of the tubular braided fabric of the invention which is identified as 10. Fabric 10 is constructed tubular which is normal in braiding. Fabric 10 is formed with two sets of yarns 14 and 16 arranged diagonally of longitudinal axis X and transverse each other. Yarns 16 are arranged about a radius which extends along an inner circumferential position Z while yarns 14 are arranged about a radius which extends along an outer circumferential position Y. Yarns 14 and 16 are tied together with longitudinally extending yarns 12 which lie substantially along an intermediate circumferential position passing alternately over yarns 14 and under yarns 16. If desired, the fabric may be slit along a desired angle and utilized as a flat fabric. Normally, fabric 10 will be utilized in circular form as a rope, shoe string, bearing linings, etc.

Turning now to FIGS. 2, 3*a*, 3*b* and 4, a detailed showing of the yarn inter-relationships which form fabric 10 is shown.

Longitudinal yarns 12 are shown extending along the fabric length in a side by side relationship. A first set of diagonal yarns 14 are shown extending diagonally of longitudinally extending yarns 12. A second set of diagonal yarns 16 are shown extending diagonally of yarns 12 and transversely of yarns 14. Yarns 14 are located always outwardly of yarns 16 to dominate the outer surface of the fabric and always below yarns 12 to form the fabric interlace. Also, yarns 16 are located always inwardly of yarns 14 to dominate the inner surface of the fabric and above yarns 12 where they cross. This arrangement limits interlacing between the forming yarns 12, 14 and 16 to the points where yarns 14 and 16 pass respectively above and below yarns 12 as indicated at 18 and 20. Preferably an interlacing point 18 and 20 is located adjacent each crossover point 22 of yarns 14 and 16.

Yarns 14 are arranged to lie substantially along an upper or outer circumference Y of fabric 10 while yarns 16 are arranged to lie substantially along a lower or inner circumference Z of fabric 10 which places them respectively on the outer and inner fabric surfaces where they predominate. Yarns 12 are disposed substantially along a circumferential position which is intermediate of the upper and lower planes. These yarns move alternately outwardly from the intermediate circumferential position to pass over yarns 14 and inwardly to pass beneath yarns 16. By arranging yarns 14 to predominately appear on the outer surface of fabric 10 and yarns 16 to predominantly appear on the inner surface of fabric 10, it is possible to form a fabric having different textures, colors, or characteristics on each surface. In the past, because of the normal over and under relationship of the diagonal yarns, this has not been possible in braiding.

By controlling the tension when the fabric is of longitudinal yarns 12 during formation of the fabric and also in use, different appearances and characteristics may be obtained. For example, if longitudinal yarns 12 are placed under tension as shown in FIG. 3*a*, outer diagonal yarns 14 are drawn downwardly into the fabric to cross under longitudinal yarn 12 substantially in the plane of inner diagonal yarns 16. For inner diagonal yarns 16, the opposite is true. The braided fabric having this yarn relationship is very stable or will show little longitudinal elongation. There can also be a patterning effect where inner yarns 16 may be visible on the outer surface.

Figure 2:
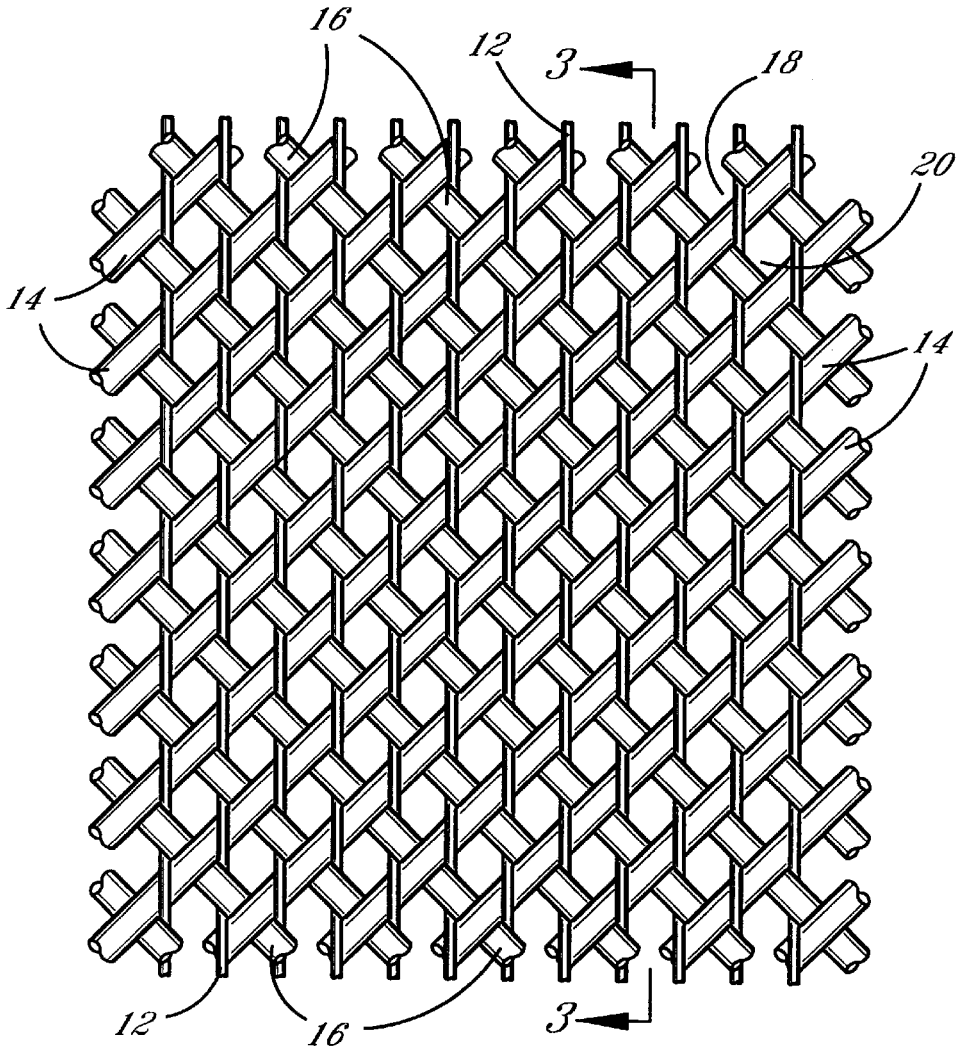
FIG. 2 is a sectional top view of the fabric of the invention.

A top view of this fabric is shown in FIG. 2.

Figure 3B:
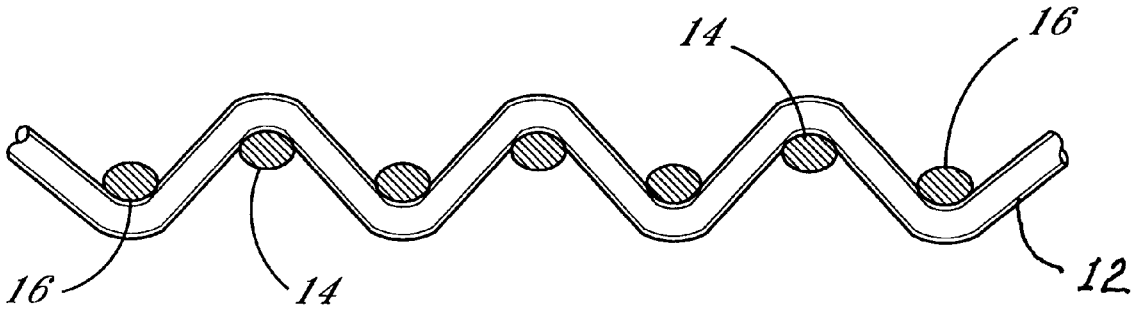
FIG. 3*b* is a sectional side view similar to FIG. 3*a* showing the fabric and the longitudinal yarn in a relaxed condition.
Figure 3A:
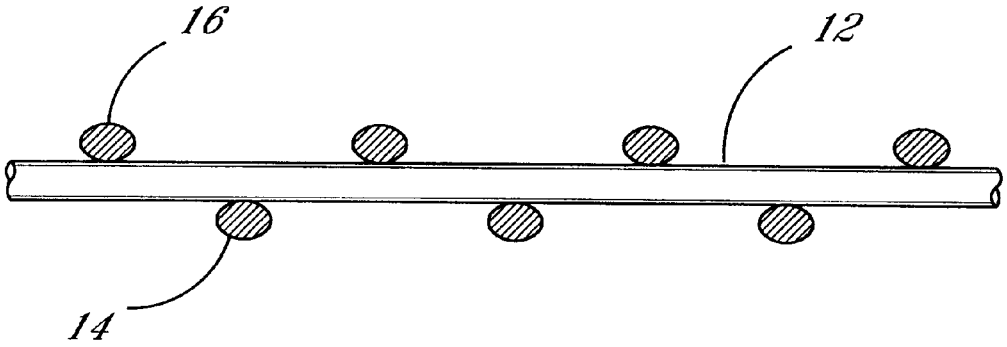
FIG. 3*a* is a sectional side view of the fabric of FIG. 2 taken along lines 3—3 showing the fabric and the longitudinal yarns in a tensioned condition.

Turning now to FIG. 3*b*, here longitudinal yarns 12 are in an untensioned or relaxed condition during braiding while slightly more tension is applied to diagonal yarns 14, 16. This results in longitudinal yarns 12 being drawn into a serpentine configuration as diagonal yarns 14 tend to remain along the outer circumferential position Y and diagonal yarns 16 tend to remain along the inner circumferential position Z where longitudinal yarns 12 pass over and under. This fabric construction allows inner diagonal yarns 16 to remain submerged in the outer fabric face and, therefore, not effect substantially the design appearance. This fabric is subject to controlled elongation, the extent being determined by the degree in which the diagonal yarns remain along their respective planes.

Figure 4:
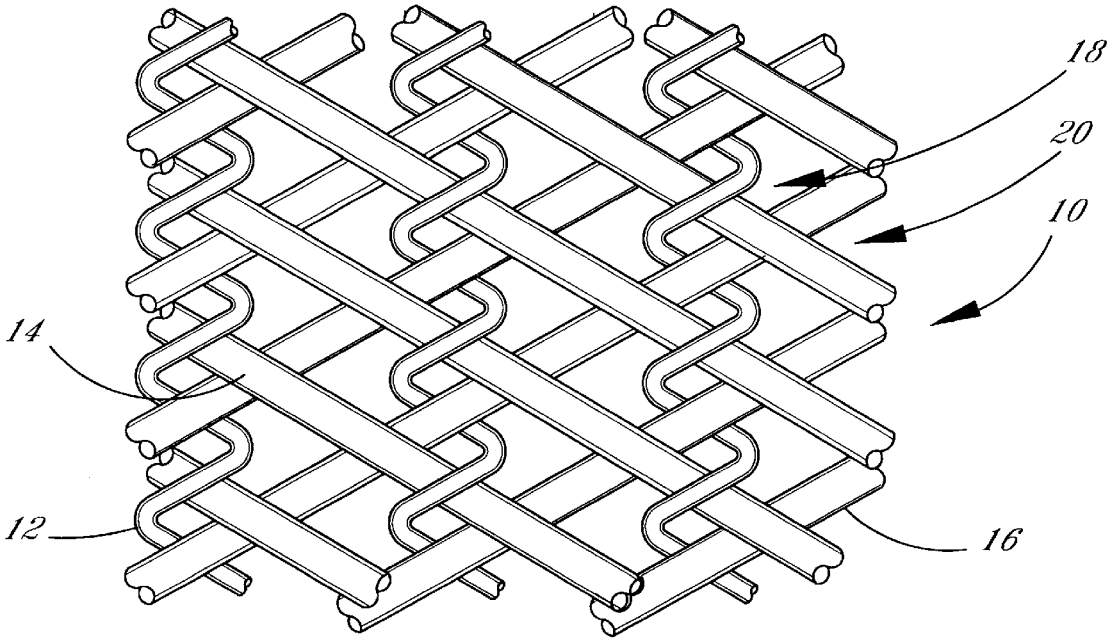
FIG. 4 is a top view similar to FIG. 2 showing the fabric and the longitudinal yarns in a relaxed condition.

FIG. 4 is a top view of the interrelationship of the yarns of this fabric arrangement.

The number of yarns 12 relative to the number of crossover points 22 is variable depending upon the stability and density desired of the fabric. Preferably, interlacing 18 and 20 are provided adjacent each crossover point 22 as shown in FIGS. 2 and 4.

Figure 5:
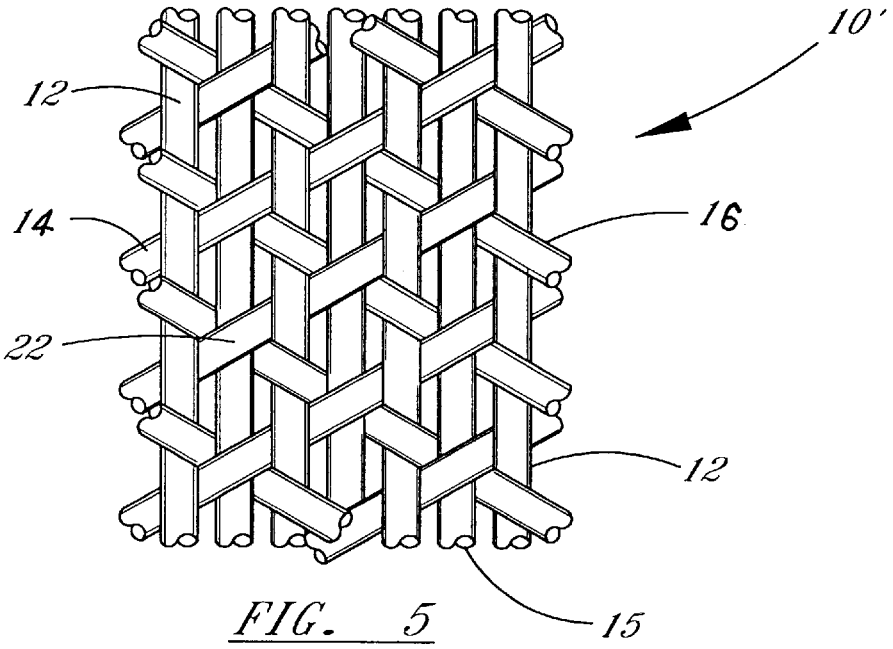
Figure 6:
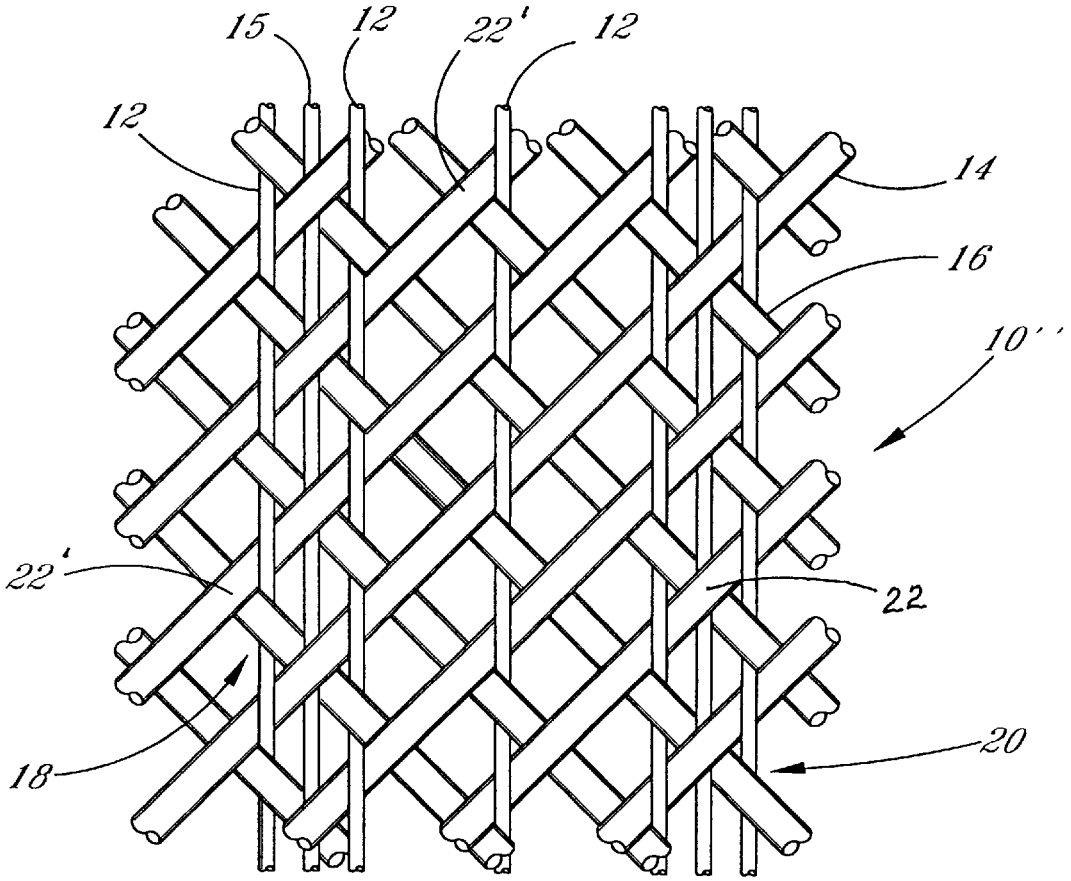
FIG. 6 is a sectional top view showing an alternative arrangement of the laid in yarns.

FIG. 5 and 6 show an alternative arrangement at 10' and 10" of the tubular braided fabric of the invention. In FIG. 5, braided fabric 10' is formed with longitudinal yarns 12, outer diagonal yarns 14 and inner diagonal yarns 16 which are interlaced as in FIG. 2. An additional longitudinal lay-in yarn 15 is provided. As shown, lay in yarn 15 is located between adjacent longitudinal yarns 12 and lies along the intermediate circumferential position beneath outer diagonal yarns 14 and above inner diagonal yarns 16 at crossovers 22. Lay- in yarns 15 may be sized as desired relative to the other fabric forming yarns. The lay in yarn does not substantially increase the stability of the fabric but it does offer additional resistance to elongation. Primarily, yarns 15 add bulk and decorative effect.

The fabric 10" shown in FIG. 6 shows an alternative arrangement to fabric 10'. Here, longitudinal yarns 12 are selectively positioned about the circumference of the fabric appearing on each side of first crossovers 22 and on only a single side of adjacent crossovers 22'.

Also, lay in yarns 15 are located longitudinally between adjacent yarns 12 and between outer and inner yarns 14, 16 at crossovers 22. Other pattern arrangements are within the scope of the invention.

It is possible to provide synthetic yarns for yarn sets 12, 14, 15 and 16 or to provide a combination of natural and synthetic yarns between each group. Normally yarns 12 are formed of a stable synthetic material while yarns 14, 15 and 16 are formed of material selected to produce a specific color, feel or functional effect.

Yarns of each yarn set 12, 14, 15 and 16 are often the same size, however the yarns between and or within the sets may vary in size as desired. Various yarn compositions may also be used to produce a desired color, feel, or functional effect.

While a preferred embodiment of the invention has been described using specific terms, such description is for illustrative purposes only, and it is to be understood that changes and variations may be made without departing from the spirit or scope of the following claims.

What is claimed is:

1. An axially stable tubular braided fabric having a longitudinal axis comprising:

a set of cylindrically arranged yarns extending parallel of said longitudinal axis of said fabric;

a first set of cylindrically arranged yarns extending substantially along a first circumferential position and disposed at an angle relative to said parallel yarns;

a second set of cylindrically arranged yarns extending transversely of said first set of yarns and substantially along a second circumferential position inwardly of said first circumferential position;

yarns of said parallel set of yarns passing consecutively over one and under the other of said yarns of said first and second sets of yarns interlocking said yarns of said first and second sets of yarns together in axially and cylindrically stable position.

2. The tubular braided fabric of claim 1; wherein said parallel yarns extend between and substantially through said first and second circumferential positions.

3. The tubular braided fabric of claim 1; wherein said yarns of said first and second sets are of a first and equal size and said yarns of said parallel set are of a second and different size.

4. The tubular braided fabric of claim 3; wherein said second size is larger than said first size.

5. The braided fabric of claim 1; wherein said yarns of at least said first and second sets are formed of synthetic material.

6. The tubular braided fabric of claim 5; wherein said yarns of said first set are formed of a synthetic material different from the synthetic material forming said yarns of said second set.

7. The tubular braided fabric of claim 5; wherein said yarns of said parallel set are formed of synthetic material.

8. The tubular braided fabric of claim 1; wherein said yarns of said first set of yarns differ in size from the yarns of said second set of yarns.

9. The tubular braided fabric of claim 1; wherein each of said first set, said second set and said parallel set of yarns is disposed throughout said fabric in equal numbers per unit area of said fabric.

10. The tubular braided fabric claim 1; wherein the number of said yarns of at least one of said first set, said second set and said parallel set of yarns differ in number per unit area of said fabric relative to said remainder of said yarn sets.

11. The method of forming a stable braided fabric along a longitudinal axis comprising;

providing first, second, and third set of yarns;

continuously delivering said yarns of said first set of yarns continuously in a first direction along substantially a first circumferential position relative to said longitudinal axis;

continuously delivering said yarns of said second set of yarns continuously in a second direction along substantially a second circumferential position inwardly of said first circumferential position, wherein said second set of yarns are disposed transverse of said first set of yarns; and continuously delivering said yarns of said third set of yarns along lines substantially parallel with said longitudinal axis while passing said yarns of said third set of yarns successively over said yarns of said first set of yarns and beneath said yarns of said second set of yarns so that said yarns of said third set of yarns bind with said yarns of said first and second sets of yarns to form a unitary braided fabric.

12. The method of claim 11 including providing a fourth set of yarns and continuously delivering said yarns from said fourth set of yarns longitudinally of said fabric substantially along a third circumferential position between said yarns of said first and second sets of yarns.

13. The method of claim 12 including selectively arranging said yarns of said fourth set of yarns cylindrically about said fabric.

14. An axially stable circular braided fabric having a longitudinal axis comprising:

a first set of yarns extending parallel of said longitudinal axis;

a second set of yarns extending along a first circumferential position substantially parallel said longitudinal axis and diagonally of said first set of yarns;

a third set of yarns extending diagonally of and outwardly of said second set of yarns;

each yarn of said second set of yarns passing beneath each yarn of said third set of yarns forming crossover points; and each yarn of said first set of yarns passing only over yarns of said third set of yarns and only under yarns of said second set of yarns adjacent said crossover points of said yarns of said second and third sets of yarns.

15. The braided fabric of claim 14 including a fourth set of yarns extending longitudinally of said fabric, said fourth set of yarns passing beneath said yarns of said third set of yarns and above said yarns of said second set of yarns at said crossover points.

16. The braided fabric of claim 15 wherein said fourth set of yarns are arranged between adjacent yarns of said first set of yarns.

17. The braided fabric of claim 14 wherein said yarns of said first, set of yarns are arranged on opposite sides of each crossover point.

18. The braided fabric of claim 14 including a fourth set of yarns arranged longitudinally of said fabric at selected intervals, said yarns of said fourth set of yarns extending below said yarns of said third set and above said yarn of said second set.

* * * * *